US007198342B2

(12) United States Patent
Mizoguchi

(10) Patent No.: US 7,198,342 B2
(45) Date of Patent: Apr. 3, 2007

(54) INK JET RECORDING APPARATUS AND INK SUPPLY MECHANISM

(75) Inventor: Yoshito Mizoguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 265 days.

(21) Appl. No.: 10/900,206

(22) Filed: Jul. 28, 2004

(65) Prior Publication Data

US 2005/0024397 A1 Feb. 3, 2005

(30) Foreign Application Priority Data

Jul. 30, 2003 (JP) ..... 2003-204079

(51) Int. Cl.
*B41J 2/195* (2006.01)
*B41J 2/17* (2006.01)
*B41J 2/175* (2006.01)

(52) U.S. Cl. ..... 347/7; 347/84; 347/85

(58) Field of Classification Search ..... 347/7, 347/84, 85

See application file for complete search history.

(56) References Cited

U.S. PATENT DOCUMENTS

| | | | | |
|---|---|---|---|---|
| 4,190,846 | A * | 2/1980 | Yamamoto et al. | 347/7 |
| 4,926,196 | A | 5/1990 | Mizoguchi et al. | 346/140 R |
| 5,382,969 | A | 1/1995 | Mochizuki et al. | 347/23 |
| 6,267,474 | B1 * | 7/2001 | Mochizuki | 347/86 |
| 6,540,321 | B1 | 4/2003 | Hirano et al. | 347/22 |
| 6,786,588 | B2 * | 9/2004 | Koyano et al. | 347/100 |
| 6,871,926 | B2 * | 3/2005 | Adkins et al. | 347/7 |
| 6,929,341 | B2 * | 8/2005 | Mizoguchi et al. | 347/7 |
| 2002/0024543 | A1 * | 2/2002 | Kimura et al. | 347/7 |
| 2002/0075364 | A1 * | 6/2002 | Takahashi et al. | 347/85 |
| 2002/0093555 | A1 * | 7/2002 | Kobayashi et al. | 347/86 |
| 2004/0012648 | A1 * | 1/2004 | Mizoguchi et al. | 347/19 |
| 2004/0021713 | A1 | 2/2004 | Mizoguchi et al. | 347/7 |
| 2004/0145635 | A1 | 7/2004 | Ebisawa et al. | 347/85 |

FOREIGN PATENT DOCUMENTS

| | | |
|---|---|---|
| JP | 11-138851 | 5/1999 |
| JP | 2000-334982 | 12/2000 |
| JP | 3180401 | 6/2001 |

* cited by examiner

*Primary Examiner*—Manish S. Shah
*Assistant Examiner*—Rene Garcia, Jr.
(74) *Attorney, Agent, or Firm*—Fitzpatrick, Cella, Harper & Scinto

(57) ABSTRACT

There is disclosed an ink jet recording apparatus which comprises a pit-in ink supply mechanism for interconnecting a main tank and a subtank to be communicated with/separated from each other, and supplying an ink from the subtank to a recording head. In this constitution, an ink residual amount V in the subtank during recording or at the end of recording is selected to be V>v/b in which V is the ink residual amount in the subtank during recording or after the end of recording, b(1>b>0) is a nonvolatile component ratio of the ink,and v is a volume of a liquid chamber of the recording head.

5 Claims, 4 Drawing Sheets

INK JET RECORDING APPARATUS AND INK SUPPLY MECHANISM

This application claims priority from Japanese Patent Application No. 2003-204079 filed Jul. 30, 2003, which is hereby incorporated by reference herein.

BACKGROUND OF THE INVENTION

1. Field of the Invention

The present invention relates to an ink jet recording apparatus which comprises an ink supply system for replenishing a subtank with an ink from a main tank.

2. Description of the Related Art

As an ink jet recording apparatus, there has conventionally been used an apparatus of a so-called serial scanning type in which a recording head as recording means and an ink tank as an ink container are replaceably mounted on a carriage movable in a main scanning direction. The ink jet recording apparatus of this type is constituted in such a manner that images are sequentially recorded on a recording medium by repeating main scanning of the carriage on which the recording head and the ink tank are mounted, and subscanning feeding of the recording medium such as a recording sheet.

If consideration is given to realization of a compact ink jet recording apparatus specialized for a digital camera (in this case, a maximum recording width is about equal to that of A6, and a so-called L size or the like of a photograph can be recorded), or a more compact ink jet printer suited to personal digital assistants (PDA), a camera or the like (in this case, a maximum recording width is about equal to that of a name card or a card size) by using such a recording system of a serial scanning type, a carriage is made compact, and thus a capacity (volume) of an ink tank mounted thereon must be greatly reduced. However, if the capacity of the ink tank on the carriage is extremely small, there is a possibility that replacement of the ink tank will become frequent, or the ink tank will have to be replaced in the middle of a recording operation.

In order to solve the aforementioned problem, Japanese Patent Application Laid-Open No. 2000-334982 or the like discloses an ink supply mechanism (referred to as a pit-in ink supply mechanism, hereinafter) for replenishing an ink containing portion (referred to as a subtank, hereinafter) on a carriage with an ink from an ink containing portion (referred to as a main tank, hereinafter) disposed on an apparatus main body side separately from the carriage at proper timing each time the carriage moves to a predetermined standby position. A capacity of the main tank is normally much larger than that of the subtank.

The pit-in ink supply mechanism is constituted in such a manner that, for example, each time recording is carried out on one recording medium, the carriage is moved to the predetermined standby position to connect the subtank on the carriage to the main tank by a joint member, and an ink is supplied from the main tank to the subtank in this connected state. In this case, since a constitution is employed to enable holding (storing) of an ink of a maximum amount likely to be consumed at least on one recording medium in the subtank, the aforementioned problem of the frequent tank replacement caused by the very small ink capacity of the subtank on the carriage can be solved. Here, the subtank is designed to be small in volume for miniaturization of the apparatus main body, which is large enough to contain an ink of an amount necessary for image recording of one recoding medium of a predetermined size assumed by the used recording apparatus.

For example, a size of the recording medium is set to 4"×6" (4 inches×6 inches) at the maximum, and a so-called L size used in photography, and a size of a postcard or the like can be contained. If resolution of a main scanning direction is 2400 dpi, and resolution of a subscanning direction is 1200 dpi, then ink drops of about 7×107 dots are discharged. In this case, if a volume of an ink drop (one droplet) discharged from a recording head is, e.g., 3 pl, a maximum ink amount necessary for recording becomes about 0.2 ml. Accordingly, by setting an ink amount used for suction recovery or pre-discharging frequently used in the normal ink jet recording apparatus to 0.05 ml, and further including a margin, a volume of the subtank can be designed to be a size large enough to contain an ink of, e.g., 0.3 ml.

The Japanese Patent Application Laid-Open No. 2000-334982 describes an ink jet recording apparatus which comprises the ink supply system (pit-in ink supply system) for replenishing the subtank on the carriage with an ink from the main tank at proper timing.

Additionally, in Japanese Patent Application Laid-Open No. 11-138851 (U.S. Pat. No. 6,540,321), there is a description to the effect that a re-soluble liquid is passed through an ink flow path to enable recovery if ink solidification (fixing) occurs in the ink flow path when a pigmented ink is used.

Furthermore, in Japanese Registered Patent No. 3180401 (U.S. Pat. No. 5,382,969), there is a description to the effect that ink consumption is blocked (work is discontinued while the ink remains) at a point of time when an ink residual amount in the subtank drops below a prescribed amount.

SUMMARY OF THE INVENTION

In the foregoing constitution, however, if the ink jet recording apparatus is left unused for a very long period of time, the ink evaporates in the subtank to greatly increase viscosity of the residual ink therein, which is much larger than viscosity of an ink used in the normal ink jet recording apparatus. Consequently, there is an inconvenience that recovery of a discharge opening (or nozzle port) of the recording head is difficult.

As an ink composition used in the normal ink jet recording apparatus, a color component of a nonvolatile dye or pigment is 10% or lower, a solvent ratio of a low-volatility solvent (e.g., glycerin, ethylene glycol or the like) is about 15% to 40%, and the remainder is mainly volatile water or alcohol. The low-volatility solvent also evaporates little by little to be strict. However, since the volatility thereof is overwhelmingly low compared with water or the like, a color material and such a low-volatility solvent will be referred to as "nonvolatile solvents" for convenience, hereinafter.

Ink viscosity when the water or the alcohol completely evaporates from the ink because the apparatus is left in the aforementioned state becomes approximately 300 mPa·s or higher at a normal temperature depending on an ink composition. Needless to say, if a large amount of a highly viscous solvent such as glycerin is used, the viscosity may further exceed the above level to reach 1000 mPa·s or higher. However, even in the case of such a highly viscous ink, as long as a deposit of a dye or urea is not fixed to the discharge opening (nozzle) to cause clogging, it is not impossible to discharge the viscosity-increased ink by applying a very high negative pressure, taking a long time to suck the ink, or keeping the recording head warm before suction to reduce viscosity of the viscosity-increased ink.

However, measurement of an ink residual amount in the subtank and investigation as to recovery performance (whether a function of a recovery process is good or bad) after the apparatus is left as it is for a long period of time, have revealed that a great reduction occurs in recovery performance if the ink residual amount exceeds a certain threshold value. That is, there is a technical problem that if an ink is pit-in supplied from the main tank to the subtank and recording is carried out after a predetermined recovery operation in a state in which the ink jet recording apparatus is left with the ink residual amount set equal to/lower than the threshold value in the subtank and the water or alcohol completely evaporates, nondischarging or a discharging failure may cause a quality reduction in a recorded image.

The present invention has been made in view of such a technical problem. It is an object of the invention to provide an ink jet recording apparatus which comprises a pit-in ink supply mechanism, and which can maintain high recovery performance of a suction recovery process if the apparatus is left as it is for a long period of time, and eliminate an inconvenience such as nondischarging or a discharging failure.

In order to achieve the foregoing object, according to the present invention, in an ink jet recording apparatus which comprises a subtank connected to a main tank for storing an ink at desired timing to be replenished with the ink, and supplies the ink from the subtank to recording means to carry out recording, an ink residual amount V in the subtank at the end of recording is $V>v/b$ in which V is the ink residual amount in the subtank after the end of recording, b ($1>b>0$) is a nonvolatile component ratio of the ink, and v is a volume of a liquid chamber of the recording means.

The present invention provides the ink jet recording apparatus which comprises the pit-in ink supply mechanism, and which can maintain high recovery performance of the suction recovery process if the apparatus is left as it is for a long period of time, and eliminate an inconvenience such as nondischarging or a discharging failure.

BRIEF DESCRIPTION OF THE DRAWINGS

FIG. 4A showing a state in which the flow path is filled with a fresh ink before the apparatus is left as it is, FIG. 4B showing a state in which a long period of time passes after a start of leaving the apparatus as it is from the state of FIG. 4A, FIG. 4C showing a state in which the apparatus is left in a state of a small ink residual amount, and a long period of time passes, and FIG. 4D showing a state in which an ink is supplied to a subtank in the state of FIG. 4C, and then a suction recovery operation is carried out.

DESCRIPTION OF THE PREFERRED EMBODIMENTS

Figure 1:
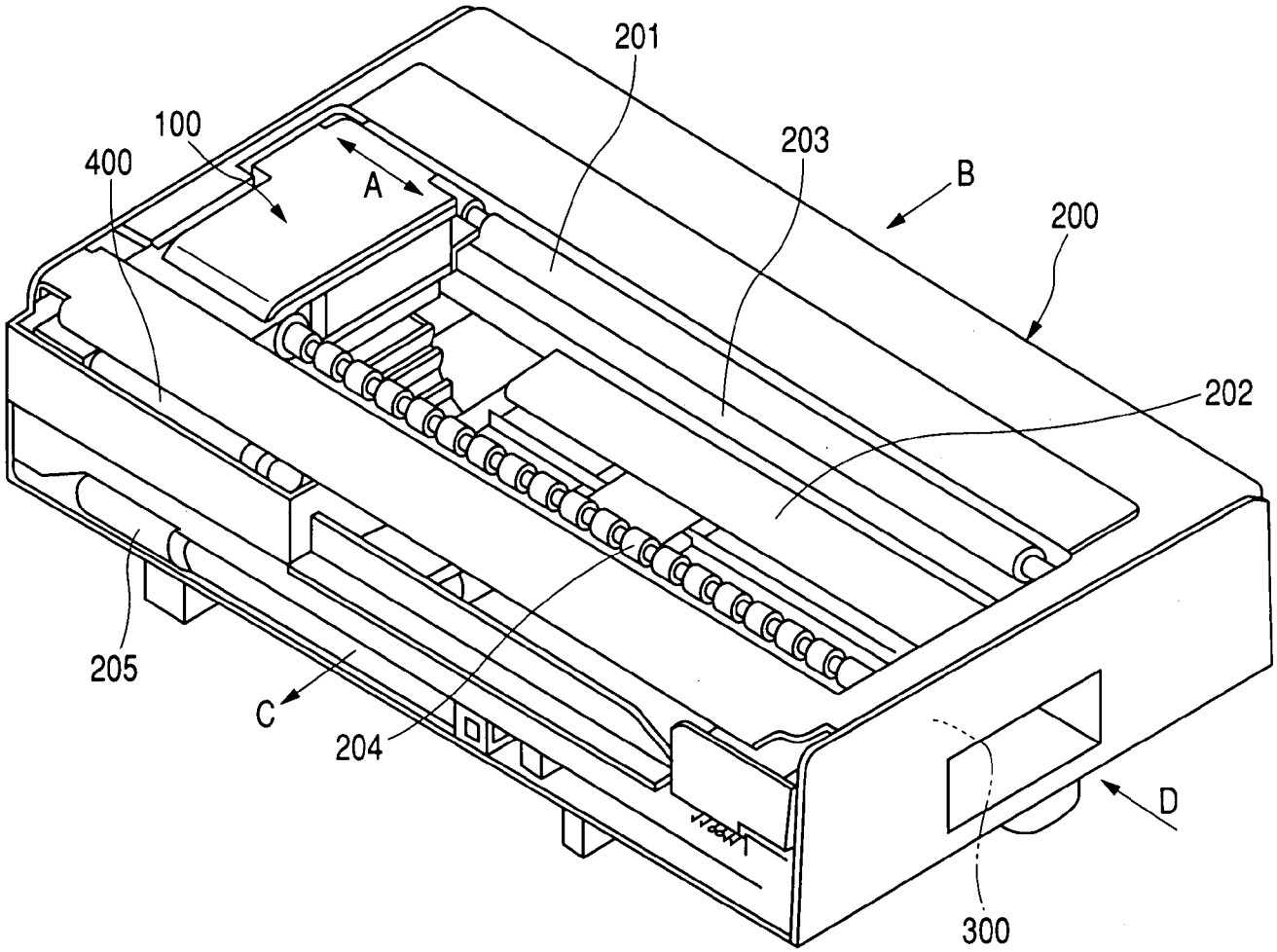
FIG. 1 is a schematic perspective view showing an outline constitution of a preferred ink jet recording apparatus to which the present invention is applied.

Next, the preferred embodiments of the present invention will be described specifically with reference to the accompanying drawings. Similar reference numerals denote similar or corresponding portions throughout the drawings.

FIG. 1 is a schematic perspective view showing an outline constitution of a preferred ink jet recording apparatus to which the present invention is applied. In FIG. 1, a reference numeral 100 denotes a carriage unit constituted by mounting a recording head 110 (see FIG. 2) as recording means on a carriage 101 reciprocated along a recording medium such as a recording sheet. An arrow A indicates a moving direction of the carriage unit 100. A reference numeral 200 denotes a main body of the ink jet recording apparatus.

The recording medium such as a recording sheet is fed in from a direction of an arrow B, conveyed on a platen 202 from the arrow B in a direction of an arrow C (subscanning direction) while it is held between a conveying roller 201 and a pinch roller, and discharged in the direction of the arrow C while it is held by a discharging roller. The recording head 110 is moved in the direction of the arrow A (main scanning direction) together with the carriage 101 (not shown), and discharges an ink from a discharge opening 112 (see FIG. 2) in accordance with an image signal (recording information), whereby an image of an amount equal to one line (or one row) is recorded on the recording medium on the platen 202. Images are sequentially recorded on the recording medium by repeating the one-line recording operation by the recording head 110, and a conveying operation of a predetermined amount of the recording medium in the direction of the arrow C (subscanning direction) by a conveying system (sheet feeding system).

While the carriage unit 100 including the recording means 110 is reciprocated in the main scanning direction of the arrow A along a guide shaft 203 and a lead screw 204, an image is recorded by discharging an ink in synchronization with this movement. A screw pin is attached through a spring to an inner surface (inner diameter portion) of a bearing with respect to the lead screw 204 of the carriage 101 (not shown) in a state of being pressed in a projecting direction. A tip of the screw pin is engaged with a spiral groove formed in an outer peripheral portion of the lead screw 204 to convert rotation thereof into reciprocation of the carriage unit 100.

Figure 2:
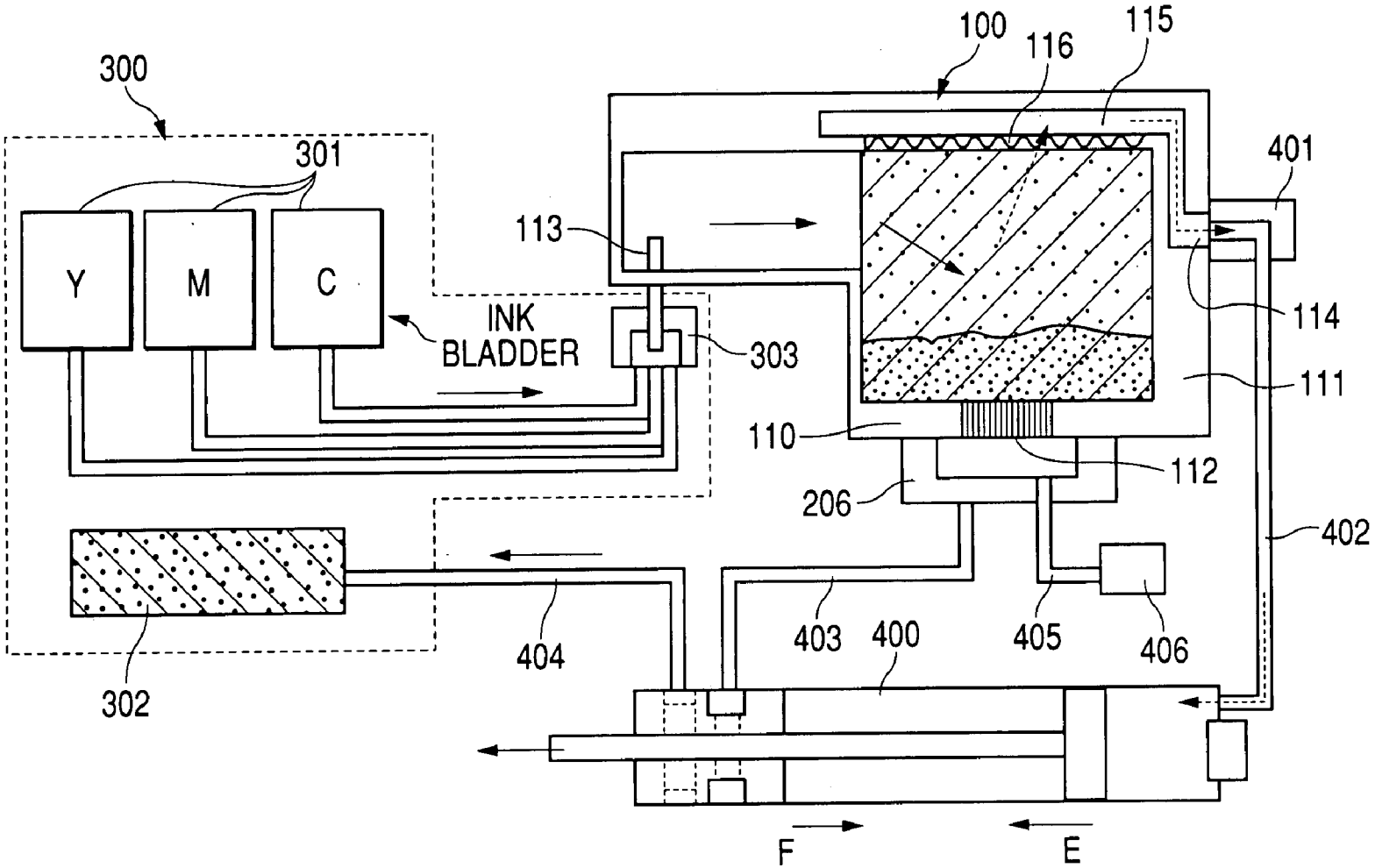
FIG. 2 is a schematic view showing a constitution of a pit-in ink supply mechanism and suction recovery means in a pit-in supplied state in the ink jet recording apparatus to which the invention is applied.

FIG. 2 is a schematic view showing a constitution of a pit-in ink supply system and suction recovery means in a state in which a subtank of the carriage unit side is connected to an ink pack (main tank) of the apparatus main body side (in a pit-in supplied state) in the ink jet recording apparatus to which the invention is applied.

In FIG. 2, the carriage unit 100 of the embodiment is constituted by mounting the recording head 110 capable of discharging inks of yellow (Y), magenta (M) and cyan (C), and a subtank 111 which is an ink containing portion for supplying an ink to the recording head 110 on the carriage 101 (not shown). A row of a plurality of discharge openings 112 arrayed in a direction which intersects the direction of the arrow A (main scanning direction) is formed in the recording head 110. That is, a plurality of discharge opening rows are disposed corresponding to the color inks, and each discharge opening row comprises a plurality of discharge openings (or nozzles) capable of discharging the inks supplied from the corresponding subtank 111.

As means for generating energy to discharge the ink, an electrothermal converter (heater element or the like) or an electromechanical converter (piezoelectric element or the like) disposed for each discharge opening 112 can be used. The electrothermal converter is operated in such a manner that it is driven to generate heat, thereby generating bubbles in the ink in the discharge opening (in the nozzle), and ink drops are discharged from the discharge opening by the bubble generation energy (generation pressure).

Regarding a main scanning movement of the carriage unit 100, its position is detected by, e.g., an encoder sensor (not shown) mounted on the carriage 101, and a linear scale (not shown) installed on the apparatus main body 200 side. A movement of the carriage unit 100 to a home position is detected by a home position (HP) sensor of the apparatus main body 200 side.

A space (distance) between the carriage unit 100 and the platen 202 can be adjusted by an adjusting mechanism (not shown). A distance between a discharge opening surface of the recording head 110 and the recording medium on the platen 202 (distance between sheets) is adjusted to about 0.8 mm, for example, when predetermined sheets are used.

Regarding a power source, the lead screw 204 is rotary-driven through a motor gear, an idler gear, and a screw gear by a carriage motor 205. Supplying of power or a signal to the recording head 110 or the like on the carriage unit 100 is carried out through a flexible cable connected to a circuit board of the apparatus main body 200 side. An LF motor and the sheet discharging roller are rotary-driven through the motor gear, the idler gear and the screw gear by an LF motor. Additionally, a piston pump 400 is disposed as a diving source to suck the ink or the like.

An ink pack 300 (FIG. 2) that constitutes the main tank is installed below the platen 202. This ink pack 300 is fixed to the inside of the apparatus main body from a direction of an arrow D in FIG. 1. The subtank 111 on the carriage 101 is normally separated from the ink pack (main tank) 300. However, during an ink supplying (ink replenishing) operation, the ink pack (main tank) 300 and the subtank 111 are interconnected by a later-described mechanism, and the ink is supplied from the ink pack to the subtank 111. In FIG. 1, in a position below the recording head 110 at the home position, a cap 206 (FIG. 2) is disposed to prevent drying of the ink in the discharge opening thereof.

The cap 206 is connected to a suction pump as described later, and used as a part of suction means for recovering ink discharging performance by sucking and discharging an ink from the discharge opening to refresh the ink therein. Accordingly, the cap 206 may be referred to as a suction cap, hereinafter. An ink absorber made of a porous material is disposed in the suction cap 206. As shown in FIG. 2, an atmosphere communication tube 405 for communicating the inside of the cap with the atmosphere, and a suction tube 404 for connecting the inside of the cap to the suction pump 400 are connected to a bottom portion of the suction cap 206. An atmosphere communication tube 405 for controlling atmosphere communication is connected to the atmosphere communication value 406. Incidentally, a wiper member (not shown) for wiping the discharge opening surface of the recording head 110 is properly disposed when necessary.

Figure 3:
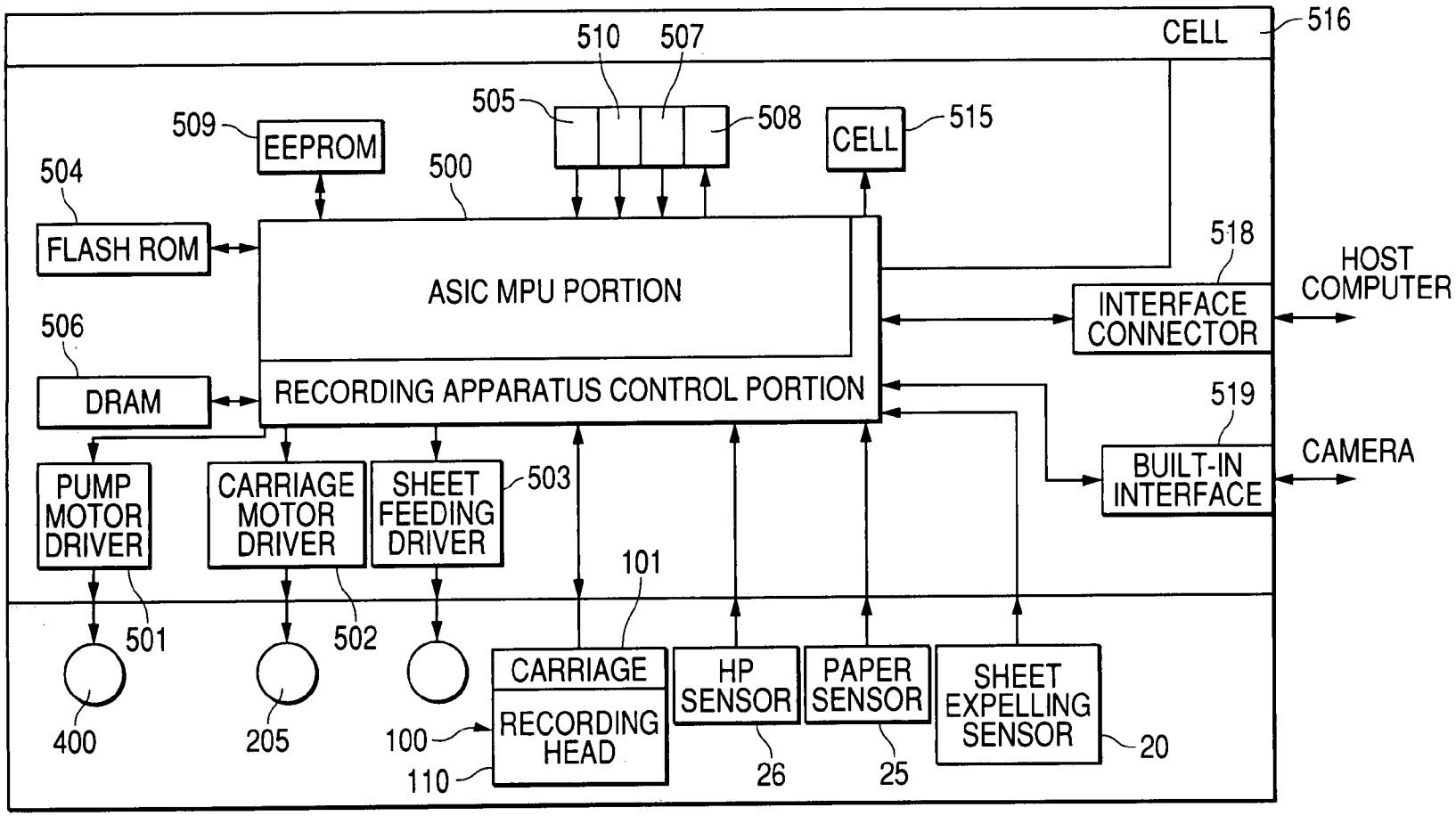
FIG. 3 is a block diagram showing a configuration of an electric control system of the preferred ink jet recording apparatus to which the invention is applied.

FIG. 3 is a block diagram showing a configuration of an electric control system of the preferred ink jet recording apparatus to which the invention is applied. In FIG. 3, a reference numeral 500 denotes an application specific integrated circuit (ASIC) in which an MPU portion and a control potion are integrated. A reference numeral 504 denotes a flash ROM which stores a program for controlling the entire recording apparatus; and 506 a DRAM used as a work area of the ASIC 500 and a buffer of a recorded image. A reference numeral 509 denotes an EEPROM. The EEPROM 509 is a rewritable ROM, and contents thereof are not erased even if no power is supplied. Thus, information of setting by a user, a used ink amount, and an ink residual amount in the subtank are written at the time of power ON.

The ASIC 500 includes a controller for heat pulse generation, and generates and transmits a control signal of the recording head 110 to the carriage unit 100. Additionally, the ASIC 500 controls the carriage 101 and the sheet feeding roller 201, executes I/O with other power sources, LED's or various sensors, and transfers data with a camera side or a computer.

A reference numeral 502 denotes a carriage motor driver for driving the carriage 101; 503 a sheet feeding driver for driving the sheet feeding roller 201; and 501 a pump motor driver for driving a piston pump 400. The carriage motor driver 502, the sheet feeding driver 503, and the pump motor driver 501 control motors based on a control signal output from the ASIC 500.

In FIG. 3, an electric cell 516 is housed (mounted) in the apparatus main body since the recording apparatus of the embodiment can be driven by a battery. An additional power source 515 is housed in the recording apparatus. Even when power is OFF for the camera, the power source 515 can be used for dating or measuring a power-OFF continuance period. A reference numeral 505 denotes a power switch for turning on power of the apparatus main body; 507 an error releasing switch; 510 a power lamp; and 508 an error lamp.

A reference numeral 518 denotes an interface connector. For example, signal communication (exchanging) with the outside such as a host computer is conducted through the interface connector 518. The interface connector 518 is connected to the host computer by wire. A reference numeral 519 denotes a built-in interface. Data transfer with a digital camera or the like is carried out through the built-in interface 519.

As a home position sensor 26 for detecting whether the carriage unit 100 is in a home position or not, for example, a sensor of a photo interrupter type is used. A paper sensor 25 and a sheet expelling (or discharging) sensor 20 for detecting presence of a recording medium such as a recording sheet in the recording apparatus are constituted of, e.g., contact type sensors.

In FIG. 2 showing the pit-in ink supply mechanism and the suction recovery means, the ink pack 300 constituting the main tank is detachably attached to the apparatus main body 200. According to the embodiment, as shown in FIG. 1, the ink pack 300 is inserted below the platen 202 of the apparatus main body 200 from the direction of the arrow D to be fixed to the apparatus main body 200. The ink pack 300 contains a plurality (3) of ink bladders 301 equivalent to main tanks of ink colors (yellow Y, magenta M, and cyan C), and a waste ink absorber 302. The ink bladders 301 are disposed corresponding to the subtanks 111 of the ink colors, and each corresponding ink bladder 301 constitutes a main tank which makes a pair with the corresponding subtank 111. An EEPROM (identification IC, not shown) is disposed in the ink pack 300. The EEPROM stores data regarding ink types contained in the ink pack 300, an ink residual amount of each color, a contained waste ink amount, and the like.

Next, in reference to FIG. 2 detailed description will be made of the constitution and the operations of the pit-in ink supply mechanism and the suction recovery means of the ink jet recording apparatus of the embodiment.

Joint rubber 303 for each ink color of the ink pack 300 mounted on the apparatus main body 200 is positioned directly below a needle (hollow needle for ink supplying) 113 of the subtank 111 of a corresponding color ink of the carriage unit 100 side moved to the home position. A joint fork (not shown) is disposed in the apparatus main body 200 to be positioned below the joint rubber 303. This joint fork moves the joint rubber 303 up and down to insert the needle 113 thereinto. Accordingly, an ink supply path is formed between the ink bladder (equivalent to the main tank) 301 of the ink pack 300 side and the subtank 111 of the carriage unit 100 side. FIG. 2 shows a state in which the ink bladder of magenta M is connected to the subtank of magenta M.

In the home position of the apparatus main body, an air cap 401 is disposed to be connected to an air suction opening 114 of the carriage unit 100 (subtank 111). An air chamber 115 is disposed in an upper portion of the subtank 111 through a gas-liquid separation film 116. The inside of the subtank 111 is connected through the gas-liquid separation film 116 and the air chamber 115 to the air suction opening 114.

On the other hand, the air cap 401 is connected through an air suction tube 402 to one side of the piston pump (suction pump) 400 as a negative pressure generation source. During ink supplying, the air cap 401 is firmly fixed around the air suction opening 114 of the carriage unit 100 side by another driving mechanism (not shown). Accordingly, the air chamber 115 of the carriage unit 100 (subtank 111) side is connected to the suction pump (piston pump) 400 to form an air suction path.

In a state in which the ink supply path is formed between the ink bladder 301 as the main tank and the subtank 111, and the air suction path is formed between the air chamber 115 of the subtank 111 and the suction pump 400 as described above, when a piston of the suction pump 400 is moved in a direction of an arrow E of FIG. 2, air is sucked from the air chamber 115. Then, air is sucked through the gas-liquid separation film 116 from the subtank 111, whereby pressure is reduced in the subtank 111, and an ink in the ink bladder (main tank) 301 is supplied through the needle (hollow needle for ink supplying) 113 to the subtank 111.

When the subtank 111 is sufficiently replenished with the ink until the ink (its liquid surface) therein reaches the gas-liquid separation film 116, the ink replenishment is automatically stopped because the gas-liquid separation film 116 blocks the passage of the ink. The gas-liquid separation film 116 is disposed in an upper portion of the subtank 111 of each color, and ink replenishment is automatically stopped for each color ink. Upon the end of the ink supplying, the air cap 401 is separated from each air suction opening 114 of the carriage unit 100. Additionally, each needle 113 is pulled out of the joint rubber 303 by lowering the joint fork.

Next, description will be made of a recovery system (recovery means) for maintaining and recovering ink discharging performance of the recording head 110 as recording means.

The discharge opening 112 is capped by abutting (firmly fixing) the suction cap 206 on the discharge opening surface of the recording head 110 which has moved to the home position. The suction cap 206 is connected through the suction tube 403 to the other side of the suction pump (piston pump) 400. The piston of the piston pump 400 is moved in a direction of an arrow F of FIG. 2 in a state in which the discharge opening 112 of the recording head 110 is sealed by the suction cap 206, whereby air is sucked from the suction cap 206 to generate negative pressure. A suction recovery operation is carried out to suck and discharge the ink from the discharge opening 112 of the recording head 110 by a suction force of this negative pressure.

When necessary, it is possible to carry out a pre-discharging operation (a kind of recovery operation) for discharging the ink from the discharge opening 112 into the suction cap 206 irrelevantly to image recording in a state in which the discharge opening 112 of the recording head 110 confronts the suction cap 206. The ink discharged into the suction cap 206 by the pre-discharging operation is discharged through the suction tube 403, the suction pump 400, the waste liquid tube 404, and a waste liquid joint (not shown) to the waste ink absorber 302 in the ink pack 300 by actuating the suction pump 400. A control valve (e.g., opening/closing valve) is disposed for a tube such as the air suction tube 402, the suction tube 403 or the waste liquid tube 404, when necessary. In various operations, an adverse influence on other sucking operations or discharging operations is prevented by opening/closing the control valve to execute a desired operation.

The suction pump 400 is constituted to be able to detect that a pump operation position is a home position by a pump home position sensor (not shown). A piston of the suction pump 400 is on standby in a position of the home position side (right side in FIG. 2) of the pump in a standby state of the recording apparatus. The atmosphere communication tube 405 for communicating the inside of the cap with the atmosphere is connected to the suction cap 206. The atmosphere communication valve 406 for controlling communication with the atmosphere is connected to the atmosphere communication tube 405.

The outline of the constitution and the operations of the pit-in ink supply mechanism and the recovery means (discharge recovery device) of the ink jet recording apparatus has been described. Hereinafter, supplementary explanation will be made of the constitution and the operations.

In FIG. 2, the ink pack 300 contains ink bladders 301 as three main tanks for storing three color inks of yellow (Y), magenta (M), and cyan (C). Each of the three ink bladders 301 has a structure in which a polypropylene (PP) bladder is laminated with aluminum foil, and evaporation of an ink is maintained in an almost zero (none) state.

The three subtanks 111 for separately storing the inks of Y, M, and C are formed in the carriage unit 100 (on the carriage 101). According to the embodiment, polysulfone of high moldability is used as a material of the subtank 111. Each ink containing portion (inside the subtank) of the subtank 111 is almost filled up with an ink absorber (sponge) 119 such as a polypropylene fiber (PP fiber) which has ink absorbing characteristics.

As described above, in each ink introduction portion of the subtank 111, the needle (hollow needle for ink supplying) 113 that has a through-hole projecting downward is disposed for each ink color. As a material of the needle 113, for example, stainless steel (SUS) is used, and a side hole is formed in a tip thereof, thereby making a structure capable of supplying the ink.

The gas-liquid separation film (or porous film) 116 is disposed in the upper portion of the subtank 111. This gas-liquid separation film 116 is treated to be water-repellent and oil-repellent, and constituted to permit passage of air but block passage of the ink. Such a gas-liquid separation film 116 is disposed for each color ink subtank. According to the gas-liquid separation film 116, the passage of the ink is blocked. Thus, when a liquid surface of the ink in the subtank 111 reaches the film 116, replenishment of the ink is automatically stopped. If it is not treated to be water-repellent or oil-repellent, the film 116 is easily wet by the ink. Especially, with the passage of used time, the ink enters small holes of the easily wet place of the gas-liquid separation film 116, and the entered ink remains there. Thus, the gas-liquid separation function is practically lost, and air introduction efficiency is reduced. Consequently, a tendency of a reduction in ink supplying efficiency easily occurs.

The air chamber 115 on the gas-liquid separation film 116 of the subtank 111 is communicated with the air suction opening 114. When the carriage unit 100 is moved to the home position during ink supplying, the air suction opening 114 can be linked (connected) to the air cap 401, and can be communicated with one cylinder chamber (right cylinder chamber in FIG. 2) of the suction pump 400. As a material of the air cap 401, for example, silicon rubber or the like is preferred, and a surrounding portion of the air suction opening 114 of the carriage unit 100 side must be sealed.

For the suction cap 206, preferably, chlorinated butyl rubber or the like of low water vapor transmittance is selected as its material in order to prevent ink evaporation from the discharge opening 112 of the recording head 110.

Silicon rubber or the like is used as a material of the tube such as the air suction tube 402, the suction tube 403 or the waste liquid tube 404 connected to the suction pump (piston pump) 400 as the negative pressure generation source. However, chlorinated butyl rubber or the like of low water vapor transmittance may be used.

The constitution, the operations and the like of the pit-in ink supply mechanism and the suction recovery means of the embodiment of the preferred ink jet recording apparatus to which the present invention is applied have been described. Next, embodiments concerning feature constitutions of the invention will be described.

First, a first embodiment will be described.

According to the embodiment, a size (inner volume) of the subtank 111 is defined so that an ink residual amount V in the subtank 111 cab become equal to/higher than a certain threshold value after the end of recording (including printing, image forming, and the like).

A volume (capacity) of the subtank 111 is preferably made as small as possible in order to install the pit-in ink supply mechanism in the compact recording apparatus. Thus, in the conventional example, a capacity of the subtank 111 is set to 0.3 ml by setting an ink amount likely to be used for recording on one or more largest recording media assumed by the recording apparatus to 0.2 ml, and an ink amount used for a recovery process (suction recovery or the like) to 0.05 ml, and adding 0.05 ml of a margin ink amount.

Accordingly, if recording of a maximum duty is actually carried out, only 0.05 ml of an ink is left in the subtank 111.

The inventors have conducted detailed measurement of an ink residual amount and studies, and discovered that when an ink residual amount V in the subtank 111 is reduced, and if the ink residual amount V is v/b or lower in which a nonvolatile component ratio of the ink is b (1>b>0), and a volume of a liquid chamber (common liquid chamber communicated with a plurality of discharge openings, see an liquid chamber 118 of each of FIGS. 4A, 4B, 4C and 4D) is v, recovery performance after the apparatus is left as it is greatly deteriorated together with the reduction in the ink residual amount V, leading to a result similar to that shown in Table 1 below.

In the Table 1, an N number indicates a number of sampling (number of samples), "OK" indicates a good recovery result, and "NG" indicates a bad recovery result.

TABLE 1

| Ink residual amount | N number and recovery result |
|---|---|
| 0.12 ml | N = 5 All OK |
| 0.11 ml | N = 5 All OK |
| 0.10 ml | N = 5 All OK |
| 0.09 ml | N = 5 4/5 OK 1/5 NG |
| 0.08 ml | N = 5 1/5 OK 4/5 NG |
| 0.07 ml | N = 5 All NG |
| 0.06 ml | N = 5 All NG |

It is obvious that when the ink is reduced in the subtank 111, the recovery performance (function of a suction recovery process or the like) becomes extremely bad from about 0.08 ml of the ink residual amount V as described above. A reason for the deterioration of the recovery process from such a certain threshold value is as follows.

Figure 4A:
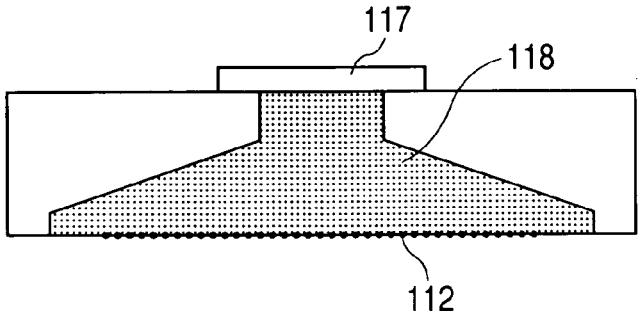
FIGS. 4A, 4B, 4C and 4D are schematic vertical sectional views showing states of an ink flow path and a discharge opening including a recording means liquid chamber of the preferred ink jet recording apparatus to which the invention is applied.
Figure 4B:
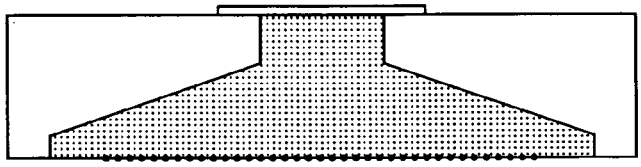
Figure 4C:
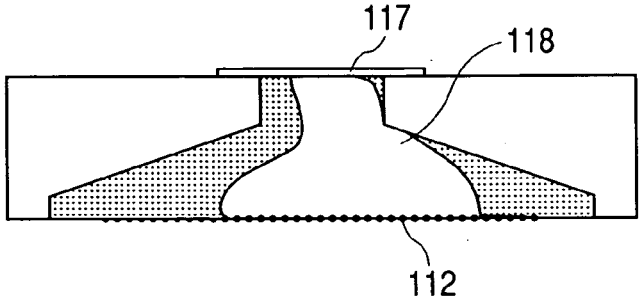
Figure 4D:
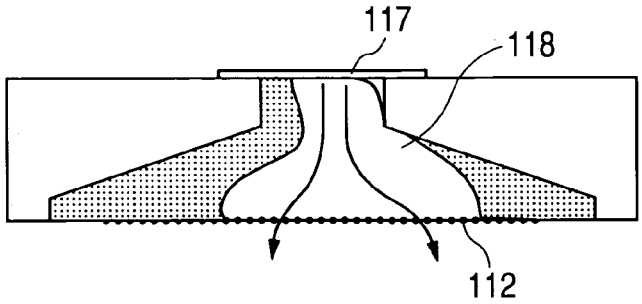

FIGS. 4A, 4B, 4C and 4D are schematic vertical sectional views showing states of an ink flow path and the discharge opening 112 including the liquid chamber 118 of the recording head 110: FIG. 4A showing a state in which the flow path is filled with a fresh ink before the apparatus is left as it is, FIG. 4B showing a state in which a long period of time passes after a start of leaving the apparatus as it is from the state of FIG. 4A, FIG. 4C showing a state in which the apparatus is left in a state of a small ink residual amount, and a long period of time passes, and FIG. 4D showing a state in which an ink is supplied to the subtank 111 in the state of FIG. 4C, and then a recovery operation is carried out.

In FIGS. 4A, 4B, 4C and 4D, a reference numeral 117 denotes an SUS filter disposed in an ink flow inlet from the subtank 111 to the recording head 110; 118 the liquid chamber (ink liquid chamber) formed in the recording head 110; and 112 the discharge opening (discharge opening row formed by arraying a plurality of discharge openings) formed in the discharge opening surface of the recording head 110. The liquid chamber 118 of the recording head 110 as the recording means constitutes a common liquid chamber communicated with the plurality of discharge openings 112. Thus, for example, it is assumed that the liquid chamber 118 is filled with a fresh ink before the apparatus is left as it is as shown in FIG. 4A.

A nonvolatile component such as water evaporates with a passage of a long period of time after the leaving is started in a state of FIG. 4A. If the apparatus is left in a state of a large ink residual amount as shown in FIG. 4A, a state is set in which the liquid chamber 118 of the recording head 110 is filled with a condensed viscosity-increased ink as shown in FIG. 4B.

However, if the apparatus is left in a state of a small ink residual amount, a state is set in which air enters the liquid chamber 118 after the leaving as shown in FIG. 4C. Especially, it has been found that in the evaporation process, the condensed ink is gradually collected at a corner of the liquid chamber 118 such as a nozzle row end (discharge opening row end) of a strong capillary force.

Consequently, even if a recovery operation such as suction recovery is carried out after an ink is supplied to the subtank 111 after the leaving, the fresh ink flows as indicated by an arrow of FIG. 4D. Particularly, recovery becomes difficult at the end of the discharge opening row 112 and the corner of the liquid chamber 118. Needless to say, if there is a re-soluble ink, the ink is dissolved to be discharged with a passage of time. However, since a level of increased viscosity is 300 Pa·s (100 pascal second) or 1000 Pa·s which is very high, and a difference from several mPa·s (normally 2 to 4 mPa·s) of a fresh ink is large, flowing of the viscosity-increased ink is difficult, and dissolving thereof takes a long time. As a result, nondischarging or the like frequently occurs especially at the end of the discharge opening row immediately after the leaving.

A reason for the impossibility of suction recovery of the viscosity-increased ink during a predetermined recovery operation before recording is that there is a difference in viscosity between a nonevaporated ink and the viscosity-increased ink, the high-viscosity ink is not moved even if suction recovery is executed before the recording, and only the low-viscosity nonevaporated ink flows from a discharge opening (nozzle) near the center unfilled with the viscosity-increased ink.

Thus, in the case of using the pit-in ink supply system in the ink supply mechanism in which a viscosity increase is especially large due to ink evaporation, a suction recovery process cannot be carried out for the viscosity-increased ink unevenly present in the liquid chamber 118 (ink drop chamber) 118 after long-time leaving. It is therefore impossible to eliminate nondischarging or a discharging failure of the recording head 110.

Thus, according to the embodiment, as for the ink residual amount V in the subtank 111 after the end of recording, a size (capacity) of the subtank 111 is selected so that V can be $V>v/b$ in which b ($1>b>0$) is a nonvolatile component ratio of the ink, and v is a volume of the liquid chamber 118 of the recording head 110.

As the ink used here, an ink whose composition is 5% of a coloring material, 20% of a nonvolatile solvent (e.g., glycerin 8%, diethylene glycol 6%, urea 5%, and surface active agent or the like about 1%), and 75% of a remaining volatile solvent (e.g., water 72.5%, isopropyl alcohol 2.5%) by weight is selected. Accordingly, since the volatile component is 75%, about ¾ of the initial ink residual amount in the subtank 111 evaporates while about ¼ remains as a nonvolatile component.

According to the embodiment, a capacity (volume) of the liquid chamber 118 of the recording head 110 is selected to be 0.02 ml, and an amount of an ink that remains even after a volatile component such as water evaporates is selected to be equal to/higher than the volume of the liquid chamber 118. This means that an ink residual amount in the subtank 111 before evaporation is selected to be larger by four times or more than the volume of the liquid chamber 118 of the recording head 110.

That is, an amount of a nonvolatile component of the ink residual amount V in the subtank 111 before leaving is $V \cdot b$ in which a volume (capacity) of the liquid chamber 118 of the recording head is v, and a nonvolatile component ratio of the ink is b ($1>b>0$), and an ink of this amount remains even if an evaporation limit is reached.

Since the amount $V \cdot b$ of the nonvolatile component is set larger than the volume v of the liquid chamber 118 ($V \cdot b>v$), the liquid chamber 118 is filled with the ink even after the long-time leaving. Accordingly, an ink jet recording apparatus is provided in which no air enters the liquid chamber 118 to form a path (straight flow path, air path) different from the case of FIG. 4C, and an inconvenience of a variance in recovery performance between discharge opening positions during recovery before recording after leaving is eliminated, and which can improve a recovery function, and easily prevent nondischarging or discharging failure.

According to the first embodiment, as the volume of the liquid chamber 118 is 0.02 ml, and the nonvolatile component ratio of the used ink is 0.25, an ink residual amount in the subtank 111 must be set equal to/higher than (0.02/0.25) ml=0.08 ml. Since the ink amount used for the recording is 0.2 ml., and the ink amount used for the recovery is 0.05 ml as described above, a total is 0.33 ml. Thus, it has been verified by setting a capacity of the subtank 111 to 0.35 ml considering a variance that a recovery process can be surely carried out after the long-time leaving even after recording of any duty is executed.

Incidentally, according to the first embodiment, regarding the recovery method, if the case is after the long-time leaving, the recovery operation is carried out in such a manner that a total amount of an ink in the subtank 111 is discharged after the ink is supplied thereto, and then the ink is supplied again to the subtank 111 to execute predetermined recovery. However, the recovery method is not limited to this method.

Now, the recovery operation which employs discharging of the total amount of the ink from the subtank 111 will be described based on the schematic view of the pin-in ink supply mechanism of FIG. 2. That is, after the recording head 110 is capped with the suction cap 206, the atmosphere communication valve 406 is closed to make the inside of the cap 206 a sealed space, and the piston in the suction pump (piston pump) 400 is moved in the direction of the arrow F (shown). Because of the presence of the greatly viscosity-increased ink in the recording head 110, an ink response in the discharge opening 112 may be slow even if negative pressure is applied in the cap 206, and no ink flow occurs even if the piston is moved to the right side (shown).

The inner negative pressure in the cap 206 is about 80 kPa at the maximum which is very strong. By continuing this state for, e.g., several tens of seconds, even the viscosity-increased ink can be discharged from the discharge opening 112 unless the ink is fixed. As described above, however, if a partial air path is formed as shown in FIG. 4C, the ink flows as indicated by the arrow in FIG. 4D even if such a recovery operation is carried out, and no sure recovery process is carried out as whole.

As the recovery method, in addition to the above, a method can be employed which discharges an ink by applying high negative pressure to the viscosity-increased ink uniformly present in the liquid chamber 118 from the state of FIG. 4B. However, even by this method, if an air path similar to that of FIG. 4C is formed in the liquid chamber 118, the recovery process becomes difficult.

In each of the aforementioned recovery operations, the subtank 111 is communicated from the gas-liquid separation film 116 and the air chamber 115 through the air suction opening 114 with the atmosphere during suction, and by opening the needle 113 without sticking the joint rubber 303. By carrying out the aforementioned suction in such an atmosphere communicated state, air is drawn from the air suction opening 114 or the needle 113 into the subtank 111, and the ink in the subtank 111 is sucked through the discharge opening (nozzle) 112 to the suction pump 400 side.

Next, description will be made of a second embodiment which comprises the feature constitution of the present invention.

According to the second embodiment, by managing an ink residual amount in a subtank, recovery performance is guaranteed after long-time leaving in the subtank smaller than that of the first embodiment.

In the second embodiment, an apparatus main body (FIG. 1), a pit-in ink supply mechanism (FIG. 2), a recording head (FIG. 2), an electric system (FIG. 3), and an ink similar to those of the first embodiment are used unless specified otherwise, and thus detailed description thereof will be omitted.

According to the embodiment (second embodiment), an ink residual amount in the subtank 111 is managed, a process such as supplying of an ink to the subtank 111 or finishing of recording is carried out when the ink residual amount in the subtank 111 reaches a threshold value equal to that of the first embodiment, and control is executed so that an ink amount present in the subtank 111 can be equal to/higher than the threshold value no matter what the amount is.

First, description will be made of means for accurately detecting an ink residual amount in the subtank 111. That is, an ink amount that can be contained in the subtank 111, or an ink amount discharged by a suction recovery operation is a fixed value, and accordingly stored in a flash ROM 504 or an EEPROM 509. Incidentally, the ink amount that fills the subtank 111, or the ink amount discharged by the suction recovery operation slightly varies from one apparatus main body (recording apparatus) to another. Thus, the accuracy of ink residual amount detection is improved more by executing control to correct such a variance.

According to the second embodiment, an application specific integrated circuit (ASIC) 500 of FIG. 3 has a function of integrating ink drops discharged by a discharging operation one by one (referred to as a dot counter, hereinafter). An ink amount in the subtank 111 can be detected by subtracting an ink amount discharged by a recovery operation and an ink amount detected by the dot counter from an ink amount that can be contained in the subtank 111. The ink amount detected by the dot counter is calculated by (ink drops counted by dot counter)×(ink consumption amount of discharged amount of one drop).

In this case, since a capacity of the subtank 111 is 0.3 ml, fineness of about 0.0001 lm is preferred for detection accuracy of the ink residual amount. As an ink amount of one ink drop slightly varies from one recording head to another, the accuracy can be improved more by correcting such a variance.

Since the ink residual amount in the subtank 111 is managed as described above, even in a small subtank, control can be executed so that an ink residual amount V therein can be set to a relation of $V>v/b$. Even after recording cancellation during recording, or in the case of leaving of the apparatus after an abnormal end due to a power failure or the like, it is possible to maintain high recovery performance (recovery process function) after long-time leaving.

According to the second embodiment, it is impossible or difficult to carry out recording of a highest duty on one largest recording medium assumed by the recording apparatus depending on an ink amount supplied by first pit-in ink supplying. Specifically, an ink of 0.3 ml is supplied into the subtank by the pit-in ink supplying for filling-up, and an ink of 0.05 ml is consumed by a recovery process. Accordingly, an ink residual amount becomes 0.25 ml. Thus, since an ink amount to be left is 0.08 ml, an ink must be supplied again by pit-in supplying (ink supplying by the pit-in ink supply mechanism) at a point of time when an ink of 0.17 ml is consumed during recording.

Such a situation occurs in the case of an image in which a recording duty is 85% or higher. In practice, such an ink shortage is quite rare during recording in the recoding apparatus of the second embodiment which assumes an output of a digital camera or the like. However, it is certainly possible to deal with a connection variance (unevenness binding) of images before/after the pit-in ink supply operation during recording by assuming such a case.

By managing the ink residual amount in the subtank 111 as described above, in addition to the effects of the first embodiment in which there are no problems in the recovery performance after the long-time leaving, according to the embodiment (second embodiment), the subtank smaller than that of the first embodiment (reductions in size and weight of the subtank) can be realized. As a result, it is possible to reduce a size of the apparatus main body more.

According to the second embodiment, the size (capacity) of the subtank 111 is smaller by about 20% compared with that of the first embodiment. Thus, if areas of bottom surfaces of the subtanks 111 are equal, there is an effect of being capable of reducing (lowering) a height thereof by about 20%. It is possible to make the recording apparatus more compact by reducing the height of the apparatus main body.

The second embodiment employs the constitution in which the ink is supplied even during the recording when the ink volume in the subtank becomes equal to/lower than a predetermined amount. However, if a recording operation can be carried out in the recording medium which is in the middle of recording even without supplying any ink, a constitution may be employed in which an ink is supplied after the end of the recording operation without executing ink supplying during the recording. Because of no ink supplying during the recording operation, this constitution enables shortening of time necessary for recording, and suppression of uneven coloring caused by a time difference in image formation before and after the ink supplying. Additionally, at the end of recording, determination is made as to whether an ink residual amount of each color in the subtank is lower than a threshold value of ink supplying or not. If an ink amount of even one color in the subtank is lower than a predetermined threshold value, a constitution can be employed in which inks are supplied to the subtanks of all the colors.

Further, in the case of a constitution of ink supplying which can change an ink amount supplied from the main tank to the subtank, an ink amount to replenish the subtank during ink supplying before recording may be an amount obtained by adding a predetermined threshold value to an ink amount necessary for image recording, an ink amount used for a recovery operation, and a margin amount. According to this constitution, since an ink equal to/higher than the predetermined threshold value remains in the subtank after the end of recording, it is not necessary to carry out an ink supplying operation again at the end of recording.

Additionally, in the case of a constitution of ink supplying which can change the ink amount supplied from the main tank to the subtank, when an ink residual amount in the subtank drops below the predetermined threshold value at the end of recording, an ink may be supplied by a small amount so as to increase the ink residual amount equal to/higher than the predetermined threshold value.

Next, description will be made of a third embodiment which comprises the feature constitution of the present invention.

According to the aforementioned second embodiment, only the ink residual amount in the subtank is managed. According to the embodiment (third embodiment), however, an ink concentration in the subtank 111 is managed in addition to the ink residual amount.

The third embodiment uses an apparatus main body (FIG. 1), a pit-in ink supply mechanism (FIG. 2), a recording head (FIG. 2), an electric system (FIG. 3), and an ink similar to those of the first embodiment unless specified otherwise, and thus detailed description thereof will be omitted.

According to the third embodiment, a sponge made of a polypropylene (PP) fiber for holding an ink is inserted (fixed) into the subtank 111. Thus, there is an ink which dyes the PP fiber sponge in the subtank 111, and additionally there is an ink stuck or trapped (closed in) in a surface layer, a corner or the like of a medium inner surface. These inks are not discharged because they are not carried on an ink or air flow even if a suction operation is carried out.

An ink amount not discharged even by such suction especially depends on a sponge density, a fiber diameter or the like in the subtank while a constitution of the subtank 111 counts. According to the third embodiment, when a sponge of 6 denier polypropylene fiber (PP fiber) which has a density of 0.4 g/cm$^3$ is used, an amount of a nonflowable ink (referred to dead ink, hereinafter) in the subtank 111 in which an ink amount of 0.3 ml is tried to be held, i.e., an ink amount not discharged even by a suction recovery operation, is 0.02 ml.

In practice, therefore, condensation of the ink by evaporation, and dilution of the ink in the subtank 111 caused by pit-in ink supplying are repeated. Even if pit-in supplying is carried out after the ink is used up, the ink never becomes a fresh ink completely in the subtank.

That is, according to the third embodiment, ink use efficiency is increased by accurately controlling an ink concentration in addition to control of the ink residual amount.

First, according to the third embodiment, an ink residual amount and an ink concentration in the subtank 111 are always managed.

The following four cases can be cited as events (operations that become causes) for changing the ink residual amount in the subtank 111. That is, a first is a case in which an ink is pit-in supplied into the subtank 111 by the pit-in ink supply mechanism, a second is a case in which an ink is consumed by suction recovery, pre-discharging, or recording, a third is a case in which an ink evaporates in the subtank 111 due to leaving, and a fourth is a case in which a total ink amount (excluding the dead ink) is pulled out (discharged) from the subtank 111.

Changes in the ink concentration in the subtank 111 are limited to the first and third cases. Here, calculation parameters are selected as shown in Table 2 for implementation of the third embodiment.

TABLE 2

| Parameter | | Unit |
|---|---|---|
| (Value before event) | Ink residual amount in subtank | V [μl] |
| | Ink concentration in subtank | a [Double] |
| Evaporation relation at time of leaving | Number of leaving days | T [day] |
| | Evaporation rate | 2.0 [μl/day] |
| Value concerning ink composition | Evaporation impossible component ratio | b (ex. 0.25) [−] |
| Value concerning ink consumption | Amount of ink consumption | c [μl] |
| Value concerning subtank | Full tank amount | 300 [μl] |
| | Dead ink amount | 20 [μl] |

The evaporation impossible component ratio means a nonvolatile component (coloring material+solvent difficult to volatilize), e.g., a value of 25%=0.25 according to the first and second embodiments.

In this case, the ink residual amount and the ink concentration in the subtank 111 after the first to fourth events are represented as shown in Table 3. On the right side of a relational expression, V indicates a current ink residual amount in the subtank, and a indicates a current ink concentration in the subtank. On the left side, V indicates an ink residual amount in the subtank 111 after each event, and a indicates an ink concentration in the subtank 111.

TABLE 3

| Event | Ink residual amount in subtank | Ink concentration in subtank |
|---|---|---|
| After pit-in operation | ○<br>v = 300 μl | ○<br>R = ((300 − V) · a)/300 |
| After ink consumption operation | ○<br>V = V − c | —<br>No change |
| After leaving (after state) | ○<br>V = Max(V × (a · b), V − 2.0 · T) | ○<br>R = V/Max(V × (a · b), V − 2.0 · T) |
| After removal of total amount | ○<br>V = 20 μl | No change |

There is change = ○
There is no change = —

Regarding the ink amount, it is obvious that the tank becomes full at 300 μl after pit-in ink supplying, and it is set to 20 μl after removal of a total amount. Additionally, after the ink consumption operation (after recording), a consumed ink amount c is counted by using the function of the dot counter described above with reference to the second embodiment, whereby an ink amount=V−c is set in the subtank 111 after the ink consumption operation.

Regarding the ink residual amount after leaving, since an ink concentration before the leaving is a, a nonvolatile component ratio before the leaving is a·b. Regarding a value {V×(a·b)} obtained by multiplying the ink residual amount V before the leaving by this (a·b), a nonvolatile component amount contained in the ink before leaving is V×(a·b).

On the other hand, as the ink evaporates at a daily rate of 2.0 μl, a residual amount T days after leaving becomes (V−2.O·T). Larger one of these (i.e., the amount does not drop below an amount equal to/higher than an evaporation limit) is an ink residual amount in the subtank 111 in which the evaporation after the leaving is added.

Regarding the ink concentration, since a concentration rate is double if a volume becomes ½ of an initial volume due to evaporation, an inverse number of a volume change is an ink concentration in the subtank 111 in which the evaporation after the leaving is added.

Further, since a pit-in supplied ink amount is 300−V if a current ink residual amount in the subtank is V, an ink concentration after the pit-in ink supplying takes a value which is obtained by adding a result of multiplying 300−V by a current ink amount and a current ink concentration in the subtank, and dividing it by a full tank amount, That is, according to the third embodiment, the constitution is employed in which V, a are updated before/after each event, and an ink state in the subtank 111 is always managed.

Then, control is executed so that a value of an evaporation impossible amount V×a·b can be larger than a volume v of the liquid chamber 118. This means control executed to set an ink residual amount V to V>v/(a·b). When an ink residual amount V in the subtank is counted to be this value by the dot counter during recording, ink supplying similar to that of the second embodiment is carried out.

That is, according to the third embodiment, since optimal control is executed in accordance with the ink residual amount and the ink concentration in the subtank 111 as described above, a delicate operation is enabled, and ink use efficiency can be increased.

Specifically, for example, if a concentration is up to a level which is larger by about 1.25 times, there is little color unnaturalness while an image density is large. Accordingly, assuming that recording is permitted under such a situation, a threshold value of V becomes $v/(a \cdot b)=0.02/(1.25 \times 0.25)=0.064$ ml, and the threshold value can be made smaller than that of the second embodiment. Thus, recording can be carried out by using more inks, ink use efficiency can be increased, and a probability of a case in which ink supplying is necessary during recording can be reduced.

Now, if ink supplying is executed not at a point of time when the ink residual amount V becomes $V=v/(a \cdot b)$ but at a point of time when it becomes (V−dead ink amount)$=v/(a \cdot b)$, reliability can be improved more. That is, as obvious from the equality to the replacement of V by (V−dead ink amount) in an expression, the ink supplying is executed when a value of a flowable ink amount=(V−dead ink amount) becomes equal to a predetermined threshold value. Thus, more reliable recovery performance can be realized.

A reason is that a dead ink is regarded as a nonflowable ink, and this is not practically contained in the "ink residual amount" of the invention. That is, a flowable ink amount=(V−dead ink amount) is set. If pit-in ink supplying to the subtank is carried out when this amount becomes a predetermined value, the ink is supplied while a greater amount of an ink remains in the subtank after all. Thus, reliability can be improved more.

Specifically, according to the third embodiment, in the example of a concentration a=1, a capacity of the subtank is 0.3 ml, a recovery amount (ink consumption amount for recovery) is 0.05 ml, and an ink residual amount to be left is "volume of liquid chamber . . . 118"×"dead . . . ink amount"=0.1 ml. Thus, an ink amount in the subtank becomes 0.25 ml after the ink is consumed in a recovery process, and a residual amount becomes 0.1 ml when 0.15 ml is consumed in recording. This residual amount 0.1 ml is equivalent to a point of (0.1 ml−dead ink amount)=0.08 ml=(four times as large as volume of liquid chamber 118) 0.02 ml. By using this point as a threshold value, an ink must be supplied again to the subtank 111.

In the foregoing, an upper limit of the ink residual amount in the subtank 111 has not been described. Needless to say, however, a viscosity-increased ink amount becomes larger when water or the like completely evaporates while a greater amount of an ink remains in the subtank 111. Therefore, suction time must be extended because of a greater amount of a viscosity-increased ink during suction recovery, creating an inconvenience of extended standby time (longer time) until recording.

Thus, preferably, the ink residual amount in the subtank 111 is set to about $10v>V>v/b$ ($10v>V>4v$ in the case of the ink of the third embodiment) to define an upper limit.

In the foregoing embodiments, the following modes of the present invention are described.

Mode 1: An ink jet recording apparatus comprising: a subtank 111 connected to a main tank 301 for storing an ink at desired timing to be replenished with the ink, the apparatus supplying the ink from the subtank to recording means 110, and discharging the ink from the recording means to carry out recording, wherein an ink residual amount V in the subtank at the end of recording is $V>v/b$ in which an ink residual amount in the subtank 111 after the end of recording is V, a nonvolatile component ratio of the ink is b ($1>b>0$), and a volume of a liquid chamber 118 of the recording means 110 is v.

According to the constitution of the Mode 1, an amount of a nonvolatile component (evaporation impossible amount) contained in the ink residual amount in the subtank 111 after the recording is equal to/higher than the volume of the liquid chamber 118 of the recording means 110. Thus, the invention provides an ink jet recording apparatus which comprises a pit-in ink supply mechanism, and which can maintain high recovery performance in a suction recovery process in the case of long-time leaving no matter what state the apparatus is left in for a long period of time, and eliminate an inconvenience such as nondischarging or a discharging failure.

Mode 2: An ink jet recording apparatus comprising: a subtank 111 connected to a main tank 301 for storing an ink at desired timing to be replenished with the ink, the apparatus supplying the ink from the subtank to recording means 110, and discharging the ink from the recording means to carry out recording, wherein ink supplying is controlled so that an ink residual amount V in the subtank during recording always satisfies a relation of $V>v/b$ in which V is the ink residual amount in the subtank after the end of recording, b ($1>b>0$) is a nonvolatile component ratio of the ink, and v is a volume of a liquid chamber 118 of the recording means 110.

According to the constitution of the Mode 2, an amount of a nonvolatile component (evaporation impossible amount) contained in the ink residual amount in the subtank 111 during the recording is equal to/higher than the volume of the liquid chamber 118 of the recording means 110. Thus, the invention provides an ink jet recording apparatus which comprises a pit-in ink supply mechanism, and which can maintain high recovery performance in a suction recovery process in the case of long-time leaving no matter what state the apparatus is left in for a long period of time, and eliminate an inconvenience such as nondischarging or a discharging failure.

Mode 3: An ink jet recording apparatus comprising: a subtank 111 connected to a main tank 301 for storing an ink at desired timing to be replenished with the ink, the apparatus supplying the ink from the subtank to recording means 110, and discharging the ink from the recording means to carry out recording, wherein ink supplying is controlled so that an ink residual amount V in the subtank during recording always satisfies a relation of $V>v/(a \cdot b)$ in which the ink residual amount in the subtank after the end of recording is V, an ink concentration in the subtank after the end of recording is a ($a>1$), a nonvolatile component ratio of the ink is b ($1>b>0$), and a volume of a liquid chamber 118 of the recording means is v.

According to the constitution of the Mode 3, the invention provides an ink jet recording apparatus which comprises a pit-in ink supply mechanism, and which can maintain high recovery performance in a suction recovery process in the case of long-time leaving while reducing a probability of ink supplying necessary during the recording no matter what state the apparatus is left in for a long period of time, and eliminate an inconvenience such as nondischarging or a discharging failure.

Mode 4: An ink jet recording apparatus comprising: a subtank 111 connected to a main tank 301 for storing an ink at desired timing to be replenished with the ink, the apparatus supplying the ink from the subtank to recording means 110, and discharging the ink from the recording means to carry out recording, wherein an ink residual amount V in the subtank at the end of recording is $V>v/b$ in which V is a flowable ink residual amount in the subtank after the end of recording, b ($1>b>0$) is a nonvolatile component ratio of the ink, and v is a volume of a liquid chamber 118 of the recording means.

According to the constitution of the Mode 4, an amount of a nonvolatile component (evaporation impossible amount) contained in the flowable ink residual amount in the subtank 111 after the recording is equal to/higher than the volume of the liquid chamber 118 of the recording means 110. Thus, the invention provides an ink jet recording apparatus which comprises a pit-in ink supply mechanism, and which can maintain high recovery performance in a suction recovery process in the case of long-time leaving no matter what state the apparatus is left in for a long period of time, and eliminate an inconvenience such as nondischarging or a discharging failure.

Mode 5: An ink jet recording apparatus comprising: a subtank 111 connected to a main tank 301 for storing an ink at desired timing to be replenished with the ink, the apparatus supplying the ink from the subtank to recording means 110, and discharging the ink from the recording means to carry out recording, wherein ink supplying is controlled so that an ink residual amount V in the subtank during recording always satisfies a relation of $V>v/b$ in which V is the flowable ink residual amount in the subtank after the end of recording, b ($1>b>0$) is a nonvolatile component ratio of the ink, and v is a volume of a liquid chamber 118 of the recording means.

According to the constitution of the Mode 5, an amount of a nonvolatile component (evaporation impossible amount) contained in the flowable ink residual amount in the subtank 111 during the recording is equal to/higher than the volume of the liquid chamber 118 of the recording means 110. Thus, the invention provides an ink jet recording apparatus which comprises a pit-in ink supply mechanism, and which can maintain high recovery performance in a suction recovery process in the case of long-time leaving no matter what state the apparatus is left in for a long period of time, and eliminate an inconvenience such as nondischarging or a discharging failure.

Mode 6: An ink jet recording apparatus comprising: a subtank 111 connected to a main tank 301 for storing an ink at desired timing to be replenished with the ink, the apparatus supplying the ink from the subtank to recording means 110, and discharging the ink from the recording means to carry out recording, wherein ink supplying is controlled so that an ink residual amount V in the subtank during recording always satisfies a relation of $V>v/(a\cdot b)$ in which the flowable ink residual amount in the subtank after the end of recording is V, an ink concentration in the subtank after the end of recording is a ($a>1$), a nonvolatile component ratio of the ink is b ($1>b>0$), and a volume of a liquid chamber 118 of the recording means is V.

According to the constitution of the Mode 6, the invention provides an ink jet recording apparatus which comprises a pit-in ink supply mechanism, and which can maintain high recovery performance in a suction recovery process in the case of long-time leaving while reducing a probability of ink supplying necessary during the recording no matter what state the apparatus is left in for a long period of time, and eliminate an inconvenience such as nondischarging or a discharging failure.

Mode 7: The ink jet recording apparatus according to any one of the Modes 1 to 6, wherein 10 $v>V$ is set for the ink residual amount V in the subtank, or the flowable ink residual amount V in the subtank.

Mode 8: The ink jet recording apparatus according to any one of the Modes 1 to 7, wherein an ink-sucking porous member containing foam or a fibrous substance is disposed in the subtank to hold the ink.

Mode 9: The ink jet recording apparatus according to any one of the Modes 1 to 8, further comprising: counting means for integrating numbers of discharged ink drops in order to manage the ink residual amount in the subtank, wherein the ink residual amount in the subtank is managed in accordance with an integration result of the counting means.

Mode 10: The ink jet recording apparatus according to any one of the Modes 1 to 9, wherein viscosity of the ink is equal to/higher than 100 mPa·s at a normal temperature in a state in which water or alcohol evaporates from the ink.

The embodiments have been described by taking the example of the serial type ink jet recording apparatus which carries out recording while moving the recording head as the recording means in the main scanning direction. However, the present invention can be similarly applied to an ink jet recording apparatus of a line system which carries out recording only in subscanning (sheet feeding) by using a line type ink jet head of a length for covering a full width or a part of a recorded material, and similar effects can be achieved.

The present invention can be freely implemented irrespective of the number of recording heads. In addition to an ink jet recording apparatus which uses one recording head, the invention can be applied to an ink jet recording apparatus for color recording which uses a plurality of recording heads using different color inks, or an ink jet recording apparatus for gradation printing which uses a plurality of recording heads using inks of similar colors but different concentrations, and further an ink jet recording apparatus which combines such apparatus, and similar effects can be achieved.

Furthermore, the present invention can be similarly applied to any arrangements of the recording head and the ink tank such as an arrangement using a replaceable head cartridge in which a recording head and an ink tank are integrated, or an arrangement in which a recording head and an ink tank are separated from each other, and these components are interconnected by a tube or the like for supplying an ink, and similar effects can be obtained.

In addition to the ink jet recording apparatus which uses the ink jet recording head of the system for discharging an ink by using thermal energy, the present invention can be similarly applied to an ink jet recording apparatus which uses an ink discharging system, for example, an ink jet recording apparatus which uses an ink jet recording head of a system for discharging an ink by using an electromechanical converter such as a piezoelectric device, and similar operations and effects can be achieved.

What is claimed is:

1. An ink jet recording apparatus comprising:

a subtank connected to a main tank for storing an ink at desired timing to be replenished with the ink, the apparatus supplying the ink from the subtank to recording means to carry out recording, wherein the apparatus further comprises control means for controlling replenishment of the ink from the main tank to the subtank, on the basis of an ink residual amount in the subtank, and the control means controls the replenishment of the ink so that an ink residual amount V in the subtank at the end of recording is $V>v/b$ in which V is the ink residual amount in the subtank after the end of recording, b ($1>b>0$) is a nonvolatile component ratio of the ink, and v is a volume of a liquid chamber of the recording means.

2. The ink jet recording apparatus according to claim 1, wherein the control means controls the replenishment of the ink so that $10v>V$ is set for the ink residual amount V in the subtank.

3. The ink jet recording apparatus according to claim 1, further comprising counting means for integrating numbers of discharged ink drops in order to manage the ink residual amount in the subtank, wherein the ink residual amount in the subtank is managed in accordance with an integration result of the counting means.

4. An ink jet recording apparatus comprising:

a subtank connected to a main tank for storing an ink at desired timing to be replenished with the ink, the apparatus supplying the ink from the subtank to recording means, and discharging the ink from the recording means to carry out recording, wherein the apparatus further comprises control means for controlling the replenishment of the ink from the main tank to the subtank, on the basis of an ink residual amount in the subtank, and the control means controls the replenishment of the ink so that an ink residual amount V in the subtank during recording always satisfies a relation of $V>v/b$ in which V is the ink residual amount in the subtank after the end of recording, b ($1>b>0$) is a nonvolatile component ratio of the ink, and v is a volume of a liquid chamber of the recording means.

5. An ink jet recording apparatus comprising:

a subtank connected to a main tank for storing an ink at desired timing to be replenished with the ink, the apparatus supplying the ink from the subtank to recording means, and discharging the ink from the recording means to carry out recording, wherein the apparatus further comprises control means for controlling the replenishment of the ink from the main tank to the subtank, on the basis of an ink residual amount in the subtank, and the control means controls the replenishment of the ink so that an ink residual amount V in the subtank during recording always satisfies a relation of $V>v/(a\cdot b)$ in which the ink residual amount in the subtank after the end of recording is V, an ink concentration in the subtank after the end of recording is a ($a>1$), a nonvolatile component ratio of the ink is b ($1>b>0$), and a volume of a liquid chamber of the recording means is v.

* * * * *